United States Patent [19]

Yajima et al.

[11] Patent Number: 4,982,433

[45] Date of Patent: Jan. 1, 1991

[54] SPEECH ANALYSIS METHOD

[75] Inventors: Shunichi Yajima, Hachioji; Akira Ichikawa, Musashino, both of Japan

[73] Assignee: Hitachi, Ltd., Tokyo, Japan

[21] Appl. No.: 375,723

[22] Filed: Jul. 5, 1989

[30] Foreign Application Priority Data

Jul. 6, 1988 [JP] Japan ..... 63-166714

[51] Int. Cl.[5] ..... G10L 5/00

[52] U.S. Cl. ..... 381/49; 381/41

[58] Field of Search ..... 381/41, 49; 364/726

[56] References Cited

U.S. PATENT DOCUMENTS 4,852,169 7/1989 Veeneman ..... 381/41

4,885,790 12/1989 McAulay ..... 381/49

*Primary Examiner*—Emanuel S. Kemeny

*Attorney, Agent, or Firm*—Antonelli, Terry, Stout & Kraus

[57] ABSTRACT

A speech analysis method which includes the steps of detecting a maximum-level position in that portion of an input speech signal which exists in a period equal to the pitch period of the input speech signal from a predetermined one of periodically-generated timing pulses, tracing the speech signal from the maximum-level position in a time reversing direction to find a zero-crossing point where the level of the traced signal is first reduced to zero, extracting a one-pitch signal which starts from the zero-crossing point and has the duration equal to the pitch period of the input speech signal, from the speech signal, and carrying out Fourier transform for the one-pitch signal to obtain a spectrum of the input speech signal.

10 Claims, 9 Drawing Sheets

| (KHz) \ (Hz) | 5 | 20 |
|---|---|---|
| 2 | 400 | 100 |
| 4 | 800 | 200 |
| 6 | 1200 | 300 |
| 8 | 1600 | 400 |
| 10 | 2000 | 500 |
| 12 | 2400 | 600 |
| 14 | 2800 | 700 |
| 16 | 3200 | 800 |

SPEECH ANALYSIS METHOD

BACKGROUND OF THE INVENTION

The present invention relates to a speech analysis method used in a speech processing apparatus, and more particularly to a speech analysis method which can reduce variations in analytical result due to a change in pitch of speech signal and can accurately analyze even a quasi-stationary speech signal.

In a speech processing apparatus, speech analysis is usually carried out to extract features of a speech. Further, in the speech analysis, window multiplication is usually carried out for a speech signal. The window multiplication suitable for use in speech analysis has been widely studied, and is described in detail, for example, on pages 250 to 260 of a book entitled "Digital Processing of Speech Signals" by L. R. Rabiner et al. (Prentice-Hall Inc.). Usually, a Hamming window having a duration of 10 to 30 msec is used for a speech signal.

Speech waveforms (a) and (b) of FIG. 2 show examples of a vowel [i:] spoken by adult men. The waveforms (a) and (b) are different in pitch period from each other, but are substantially equal in shape of one-pitch waveform portion to each other. Accordingly, a listener cannot detect the difference in tone quality between the speech waveforms (a) and (b).

The speech analysis is required to obtain spectral information independent of the pitch period. That is, it is required that the analytical results of the speech waveforms (a) and (b) are identical with each other. According to a conventional speech analysis method, however, the analytical results of the waveforms (a) and (b) are greatly different from each other. FIG. 3 shows spectra which are obtained by extracting a one-pitch waveform from each of the speech waveforms (a) and (b) of FIG. 2, and by carrying out discrete Fourier transform (DFT) for the extracted one-pitch waveforms. Although only higher harmonics of the pitch frequency (that is, reciprocal of the pitch period) are obtained by the DFT, curves obtained by carrying out linear interpolation for the higher harmonics are shown in FIG. 3. A formant frequency which has the highest level in FIG. 3, is the reciporcal of the pitch period of the first formant component shown in FIG. 2. In the speech waveforms (a) and (b) of FIG. 2, the first formant component has the same period (that is, a period of 3.45 msec) and thus a formant frequency of 290 Hz. While, the speech waveform (a) has a pitch frequency of 130 Hz, and the speech waveform (b) has a pitch frequency of 115 Hz. As can be seen from FIG. 3, the spectrum of a speech signal is changed when the pitch frequency thereof varies. A change in spectrum is remarkable when the difference between the formant frequency and a harmonic of the pitch frequency is large.

Even when the analytical region for speech analysis is enlarged and thus the frequency resolution is enhanced, it is impossible to detect the first formant component accurately. FIG. 4 shows a spectrum which is obtained by extracting a double-pitch waveform from the speech waveform (b) of FIG. 2 and by carrying out the DFT for the extracted waveform. The spectrum of FIG. 4 has a frequency resolution of 57.5 Hz (namely, 115/2 Hz), because the analytical region is doubled. Thus, a Fourier component having a frequency of 287.5 Hz is obtained. The frequency of this spectral line (namely, 287.5 Hz) is nearly equal to the formant frequency having the highest spectral level (namely, 290 Hz), but the level of the above spectral line is very low. This is because adjacent one-pitch waveforms are different in phase of the first formant component from each other. The degree of phase shift can be known from the decimal part of a quotient which is obtained by dividing the pitch period of a speech signal by the period of the first formant component. When the decimal part of the quotient is zero, the adjacent one-pitch waveforms are equal in phase of the first formant component to each other. When the decimal part of the quotient is 0.5, the adjacent one-pitch waveforms are opposite in phase of the first formant component. For example, in the speech waveform (b) of FIG. 2, the pitch period is 8.7 msec, and the period of the first formant component is 3.45 msec. Accordingly, the quotient which is obtained by dividing the former period by the latter period, is 2.52, and the decimal part of the quotient is 0.52. Thus, adjacent one-pitch waveforms are substantially opposite in phase of the first formant component to each other.

As mentioned above, variations in spectrum of speech signal due to a change in pitch period of the speech signal is based upon a fact that adjacent one-pitch waveforms of the speech signal are different in phase of the first formant component from each other. Such variations in spectrum cannot be eliminated by increasing the number of one-pitch waveforms included in the analytical region or by carrying out window multiplication for the speech signal.

SUMMARY OF THE INVENTION

It is accordingly an object of the present invention to provide a speech analysis method which can eliminate variations in spectrum of speech signal due to a change in pitch period thereof, and can accurately analyze the speech signal without being affected by the change in pitch period.

In order to attain the above object, according to the present invention, there is provided a speech analysis method which includes the steps of detecting a maximum-level position in that portion of an input speech signal which exists in a period equal to the pitch period of the input speech signal from a predetermined one of periodically-generated timing pulses, tracing the speech signal from the maximum-level position in a time reversing direction to find a zero-crossing point where the level of the traced signal is first reduced to zero, extracting a one-pitch waveform which starts from the zero-crossing point and has a duration equal to the pitch period of the speech signal, from the speech signal, and carrying out Fourier transform for the extracted one-pitch waveform to obtain a spectrum of the input speech signal.

The characteristic features of the present invention will be explained below in more detail. In general, the first formant component of a speech signal is considered to be a damped sinusoidal wave which is excited at an interval equal to the pitch period of the speech signal. As mentioned above, adjacent one-pitch waveforms of the speech signal are usually different in phase of the first formant component from each other. In order for the first formant component to hold the same phase, at least a waveform having a duration less than or equal to the pitch period is to be used as the analytical region. Even when the duration of the analytical region is made equal to the pitch period of the speech signal, there is a fear that a phase shift of the first formant component occurs in the analytical region. Accordingly, it is required to place the starting point of the analytical region in the vicinity of the maximum-level position. This problem will be explained below in more detail, with reference to FIG. 1.

FIG. 1 is a waveform chart for explaining an inventive speech analysis method which is carried out for the speech waveform (b) of FIG. 2. Referring to FIG. 1, when the analytical region having a duration A longer than the pitch period of the speech signal (b) is used, the phase of the first formant component changes in the analytical region. Hence, it is necessary to make the duration of the analytical region equal to the pitch period of the speech signal. In a case where the analytical region has a duration which is indicated by reference character B and is equal to the pitch period, however, the phase of the first formant component can vary. Now, attention is paid to the fact that the first formant component can be approximated by a damaged sinusoidal wave. Thus, a maximum-level position in that portion of the speech signal which has a duration equal to the pitch period, is detected, and the speech signal is traced from the maximum-level position in a time reversing direction to find a zero-crossing point where the level of the traced signal is first reduced to zero. When the analytical region starts from the zero-crossing point and has a duration equal to the pitch period, the analytical region is free from the phase shift of the first formant component, and thus a stable analytical result can be obtained. This analytical region is indicated by reference character C in FIG. 1. It is to be noted that a zero level indicates the mean value of the signal level in a one-pitch waveform.

As mentioned above, an accurate analytical result can be obtained by using the one-pitch waveform C as the analytical region. In the above, however, no attention is paid to frequency resolution. When speech analysis is made in the analytical region C, the frequency resolution is equal to the reciprocal of the pitch period (that is, pitch frequency). In ordinary cases, the frequency resolution thus obtained lies in a range from 70 to 500 Hz. Accordingly, the analytical result will be low in frequency resolution. The frequency resolution can be enhanced by using a virtual waveform $W_I$ which is obtained by adding a zero-level signal to the one-pitch waveform C, as the analytical region. The virtual waveform $W_I$ will be hereinafter referred to as "zero-inflated one-pitch waveform". When the waveform $W_I$ has a duration of T sec, the analytical result which is obtained by using the waveform $W_I$ as the analytical region, has a frequency resolution of (1/T)Hz. By selecting the value of the time T appropirately, the analytical result is able to have high frequency resolution.

DESCRIPTION OF THE PREFERRED EMBODIMENTS

Figure 5:
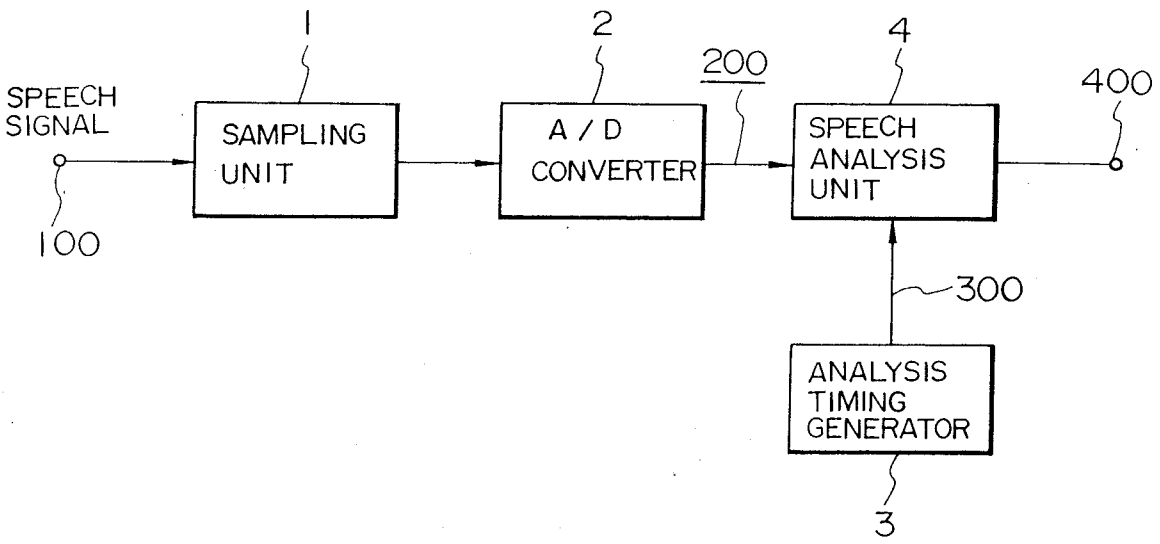
FIG. 5 is a block diagram showing the main parts of a speech analysis apparatus, to which the present invention is applied.

FIG. 5 is a block diagram showing an ordinary speech analysis apparatus. Referring to FIG. 5, an input speech signal 100 is converted into a digital signal 200 by a sampling unit 1 and an A-D converter 2, and an analysis timing generator 3 generates timing pulses 300 at a predetermined interval $T_S$ (namely, at an interval of 10 to 20 msec). Further, a speech analysis unit 4 generates a spectral signal 400 on the basis of the digital signal 200 and the timing pulses 300.

The gist of the present invention resides in the operation of the speech analysis unit 4. Now, explanation will be made of an embodiment of a speech analysis unit according to the present invention, with reference to FIGS. 6 and 7.

Figure 6:
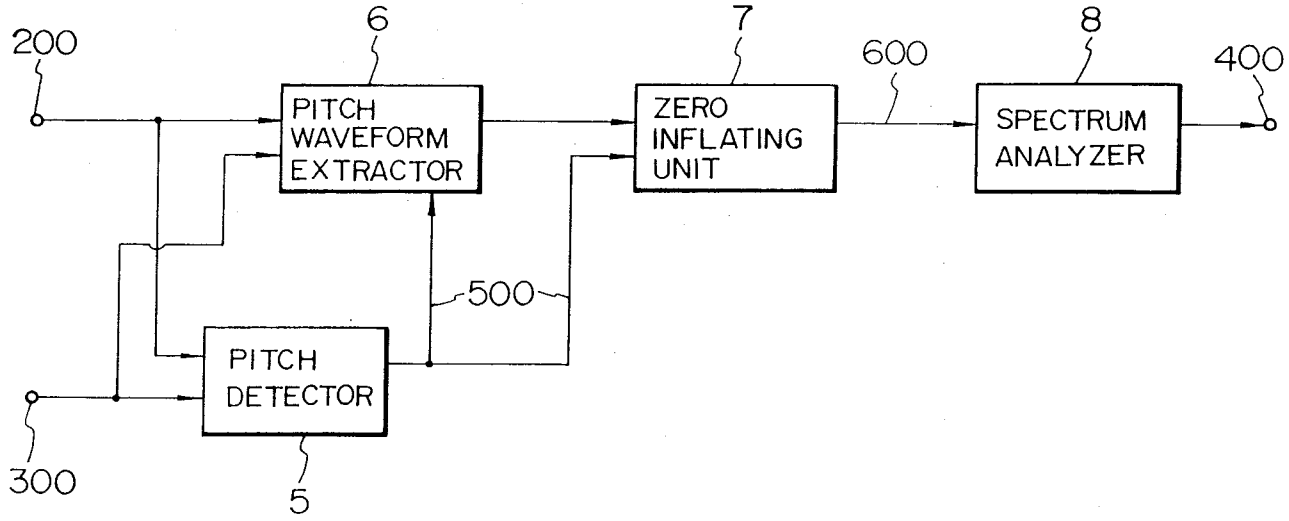
FIG. 6 is a block diagram showing an embodiment of a speech analysis unit according to the present invention.

Referring to FIG. 6, a pitch detector 5 detects the pitch period of that portion of the digital signal 200 which exists between a predetermined one of the timing pulses 300 and a timing pulse adjacent to the predetermined pulse, by the autocorrelation method, and delivers a periodic signal 500 having a period equal to the detected pitch period. The processing carried out by the pitch detector 5 is described in, for example, an article entitled "Average Magnitude Difference Function Pitch Extractor" by M. J. Loss et al. (IEEE Transactions on ASSP, Oct., 1974).

A pitch waveform extractor 6 extracts one-pitch waveform data which starts from a predetermined one of the timing pulses 300, from the digital signal 200. The operation of the pitch waveform extractor 6 will be explained below, with reference to FIG. 7.

Figure 7A:
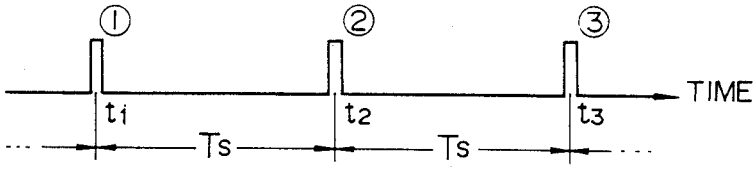
FIGS. 7*a*, 7*b* and 7*c* form a waveform chart for explaining a processing procedure according to the present invention.
Figure 7B:
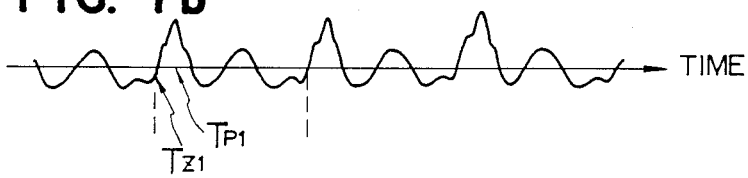
Figure 7C:
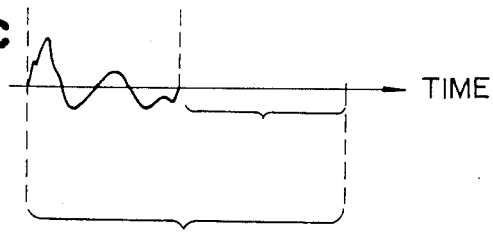

Referring to FIG. 7, let us suppose that a timing pulse ① is specified, that is, a time $t_1$ is the specified time. A maximum signal level in that portion of the digital signal 200 which starts from the time $t_1$ and has a duration equal to the period of the periodic signal 500, is searched for, and a time $t_{P1}$ when the maximum level appears, is detected. Then, the digital signal 200 is traced from the time $T_{P1}$ in a time reversing direction, to find a time $t_{Z1}$ when the level of the traced signal is reduced to a zero level or coincides with the zero level. Next, one-pitch waveform data starting from the time $t_{Z1}$ is extracted from the digital signal 200.

A zero inflating unit 7 adds zero-value data, the number of which is equal to the difference between the number of data points of Fourier transform and the number of sampling points in the one-pitch waveform data, to the one-pitch waveform data, to form a zero-inflated, one-pitch waveform 600. This waveform 600 corresponds to the waveform $W_I$ of FIG. 1. The above processing of the zero inflating or empadding unit 7 is carried out to obtain predetermined frequency resolution. The number of zero-value data added to the one-pitch waveform data will be explained later. A spectrum analyzer 8 carries out Fourier transform and absolute-value processing for the zero-inflated one-pitch waveform 600, to produce the spectral signal 400. Incidentally, the fast Fourier transform (FFT) is used for carrying out the above Fourier transform at high speed.

Next, explanation will be made of the number of zero-value data which are added to the one-pitch waveform data by the zero inflating unit. The number of added zero-value data depends upon desired frequency resolution. The present inventors heard a large number of synthetic sounds which were different in frequency resolution from each other, to estimate the tone quality of each synthetic sound, and found that the tone quality was greatly degraded when the frequency resolution was made greater than 20 Hz, but was kept unchanged when the frequency resolution was made less than 5 Hz. That is, it is preferable to put the frequency resolution within a range from 5 to 20 Hz.

Figures 8, 9:
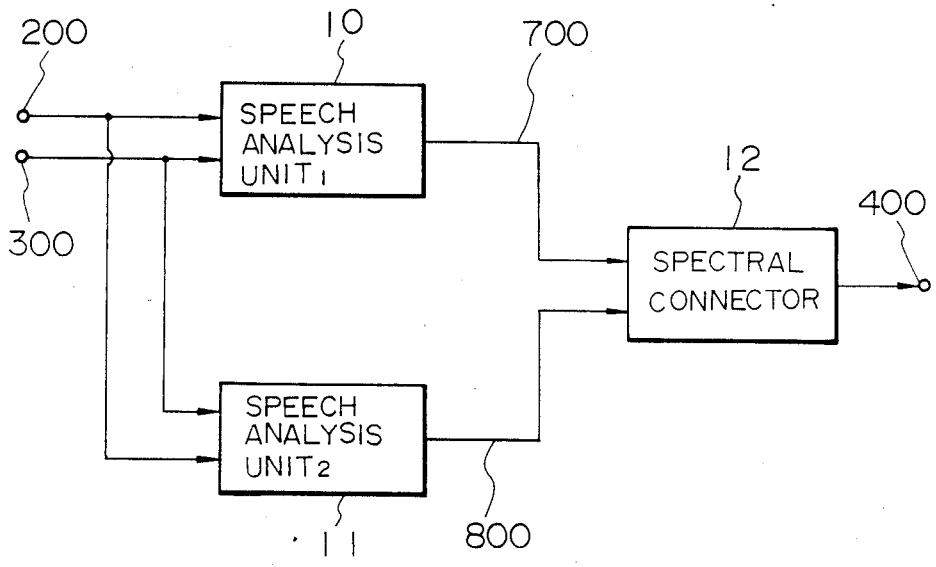
FIG. 8 is a table showing the number of sampling points necessary for attaining favorable frequency resolution.
FIG. 9 is a block diagram showing another embodiment of a speech analysis unit according to the present invention.

FIG. 8 shows the number of sampling points necessary for obtaining predetermined frequency resolution. In FIG. 8, numerals 2, 4, 6, . . . , and 16 arranged in a longitudinal direction indicate sampling frequencies, and numerals 5 and 20 arranged in a transverse direction indicate frequency resolution.

The FFT is used for carrying out Fourier transform at high speed. In the FFT, however, it is required to make the number of processing points equal to the n-th power of 2 (where n is a positive integer). In order to carry out the FFT so that the frequency resolution lies in the range of FIG. 8 (that is, a range from 5 to 20 Hz), it is necessary to make the number of sampling points (that is, processing points) equal to 512 or 1,024 for a case where a sampling frequency of 8 KHz is used. In this case, the use of 512 processing points corresponds to a frequency resolution of 15.625 Hz, and the use of 1,024 processing points corresponds to a frequency resolution of 7.8125 Hz.

In the zero inflating unit 7, zero-value data, the number of which is equal to the difference between the number of processing points used in the FFT and the number of sampling points in the one-pitch waveform data, are added to the one-pitch waveform data. In the spectrum analyzer 8, the FFT using the above processing points is carried out. For example, in a case where 512 processing points are required and 60 sampling points are included in the one-pitch waveform data, 452 zero-value data are added to the one-pitch waveform data, and the FFT using 512 processing points is carried out.

Next, explanation will be made of another embodiment of a speech analysis unit according to the present invention, with reference to FIG. 9.

The embodiment of FIG. 6 is excellent in extraction accuracy for a low-frequency spectral component, but is low in extraction accuracy for a high-frequency spectral component. In order to solve this problem, according to the present embodiment, the low-frequency spectral component is detected by the embodiment of FIG. 6, and the high-frequency spectral component is detected by a conventional method.

Referring to FIG. 9, a first speech analysis unit 10 is formed of the embodiment of FIG. 6, and delivers a first spectral signal 700. Further, a second speech analysis unit 11 carries out a conventional speech analysis method. That is, one of a Hamming window, a Hanning window and other windows is used for a fixed-time waveform which includes a plurality of consecutive one-pitch waveforms and has a duration of about 20 msec, and then the Fourier transform is carried out for the windowed waveform to obtain a second spectral signal 800. The above-mentioned conventional method is described, for example, on page 460 of an article entitled "Speech Analysis-Synthesis System Based on Homomorphic Filtering" by A. V. Oppenheim (J.A.S.A. Vol. 45, No. 2, 1969). It is to be noted that the first and second speech analysis units are made equal to each other in the number of processing points used in Fourier transform. In a spectral connector 12, the first spectral signal 700 and the second spectral signal 800 are combined to form the spectral signal 400.

According to the inventors' experiments, it is preferable to use a fixed frequency of 500 to 600 Hz or a frequency three times higher than the pitch frequency of the input speech signal, as the boundary frequency in the spectral connector 12.

Figure 10:
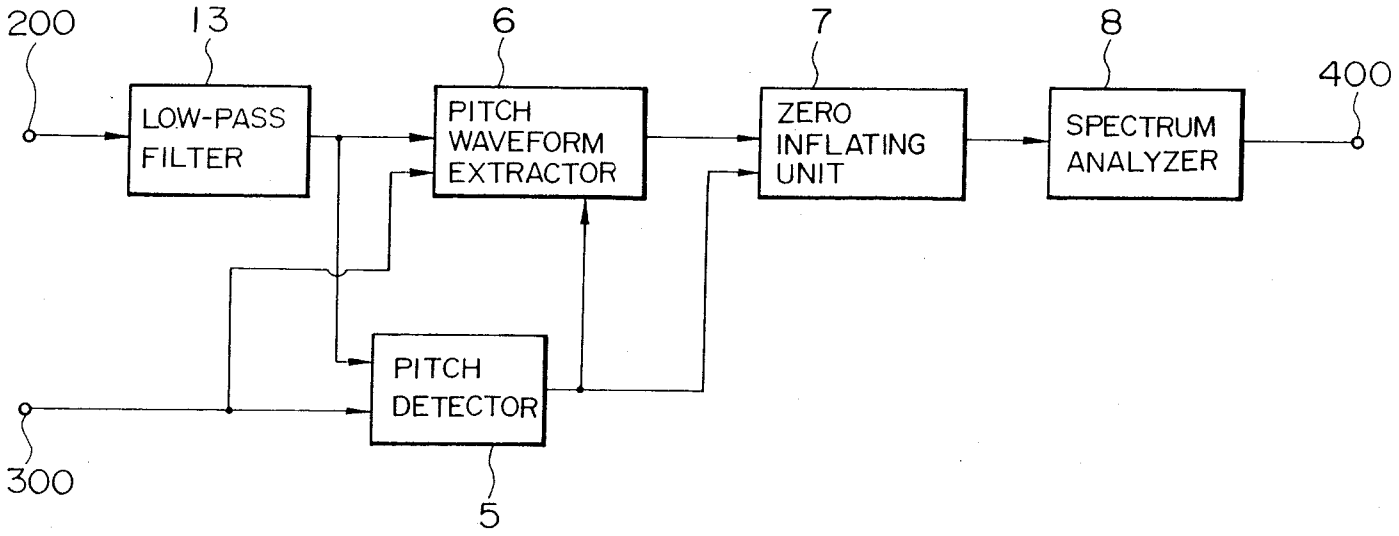
FIG. 10 is a block diagram showing a further embodiment of a speech analysis unit according to the present invention.

FIG. 10 is a block diagram showing a different embodiment of the first speech analysis unit 10 of FIG. 9. The present embodiment is different from the embodiment of FIG. 6 only in that a low pass filter 13 is additionally provided. It is desirable to put the cut-off frequency of the low pass filter 13 in a range from 800 to 1,000 Hz, since the effect of the side lope of a high frequency component on the first spectral signal can be reduced. In this case, however, it is necessary to use a fixed frequency of 500 to 600 Hz as the boundary frequency in the spectral connector 12. The design and construction of a low pass filter are minutely described in, for example, a book entitled "Digital Signal Processing" by A. V. Oppenheim (Prentice-Hall Inc.).

Speech analysis technology is used in various speech processing fields, and a speech analysis method according to the present invention is applicable to a speech analyzing/synthesizing apparatus. When an inventive speech analysis method is used in a speech analyzing/-synthesizing apparatus, the performance of the apparatus will be improved, since a stable, accurate analytical result can be obtained by the speech analysis method, without being affected by variations in pitch period of speech signal.

Figure 11:
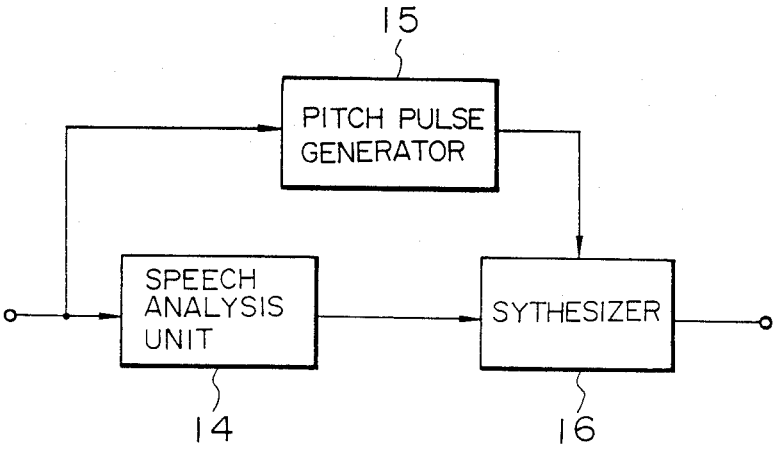
FIG. 11 is a block diagram showing an example of a speech analyzing/synthesizing apparatus which example includes a speech analysis unit according to the present invention.

FIG. 11 is a block diagram showing an embodiment of a speech analyzing/synthesizing apparatus according to the present invention. A speech analyzing/synthesizing apparatus is minutely described in, for example, an item "Homomorphic Vocoders" of a book entitled "Speech Analysis Synthesis and Perception" by J. L. Flanagan.

Referring to FIG. 11, a speech analysis unit 14 is formed of one of the embodiments of FIGS. 6, 9 and 10, and a pitch pulse generator 15 detects the pitch period of an input speech signal to generate pitch pulses at an interval equal to the detected pitch period. Further, a synthesizer 16 generates a waveform corresponding to the frequency spectrum from the speech analysis unit 14, each time the pitch pulse is applied to synthesizer 16. The waveforms thus produced are successively combined to form a speech output waveform. The waveform corresponding to the frequency spectrum can be obtained in such a manner that a zero-phase or minimum phase is given to the spectrum and inverse Fourier transform is carried out for the spectrum. The pitch pulse generator 15 and the synthesizer 16 are described minutely in the above-referred book by J. A. Flanagan, and hence can be readily constructed by those skilled in the art.

Figure 12:
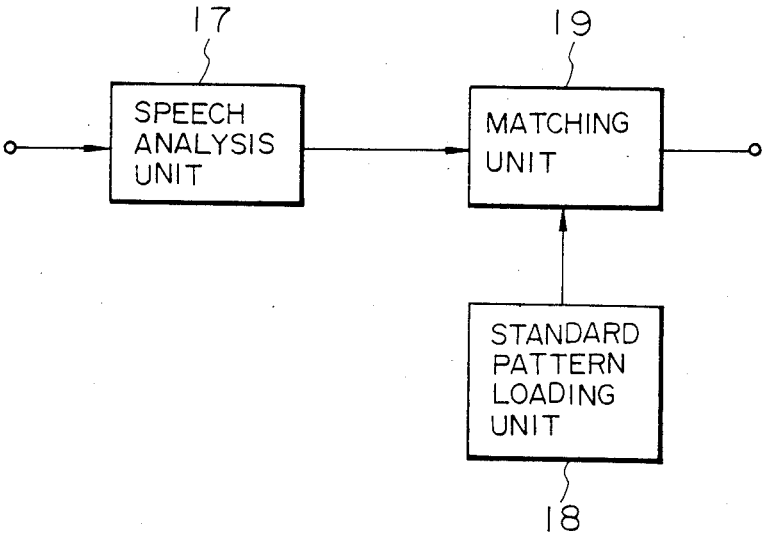
FIG. 12 is a block diagram showing an example of a speech recognition apparatus which example includes a speech analysis unit according to the present invention.

FIG. 12 is a block diagram showing an embodiment of a speech recognition apparatus according to the present invention. A speech recognition apparatus is minutely described in a book entitled "Automatic Speech & Speaker Recognition" edited by T. B. Martin.

Referring to FIG. 12, a speech analysis unit 17 is formed of one of the embodiments of FIGS. 6, 9 and 10, and delivers the frequency spectrum of an input speech signal. Standard patterns which are previously stored in a standard pattern loading unit 18, are successively read out, to be compared with the spectrum from the speech analysis unit 17. A matching unit 19 detects a standard pattern which has the greatest resemblance to the spectrum, and delivers a category, to which the detected standard pattern belongs. The standard pattern loading unit 18 and the matching unit 19 are minutely described in the above-referred book edited by J. B. Martin, and hence can be readily constructed by those skilled in the art.

Figure 1A:
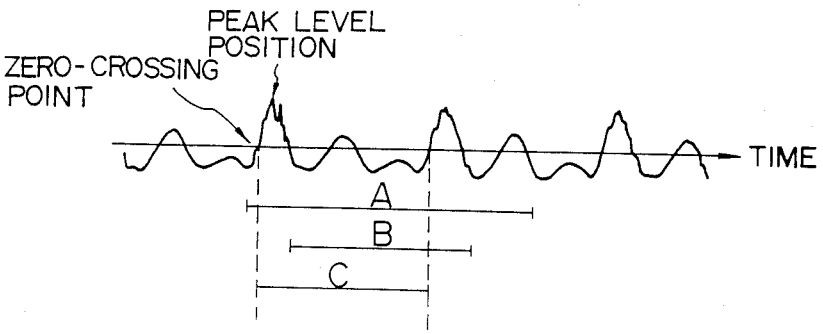
FIGS. 1*a* and 1*b* form a waveform chart for explaining the operation principle of the present invention.
Figure 1B:
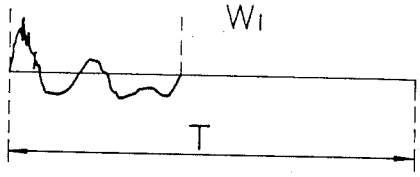
Figure 2A:
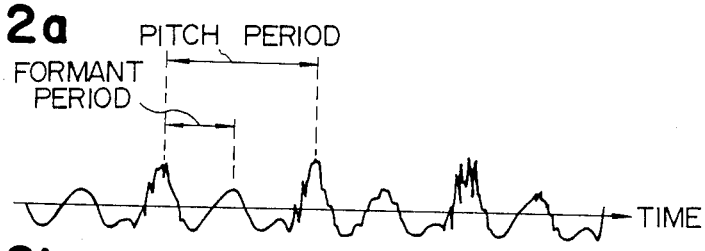
FIGS. 2*a* and 2*b* form a waveform chart showing two speech waveforms which are different in pitch period from each other.
Figure 2B:
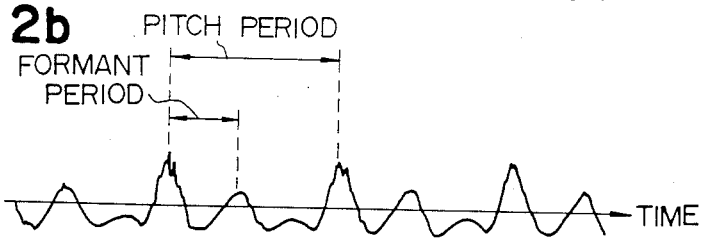
Figure 3:
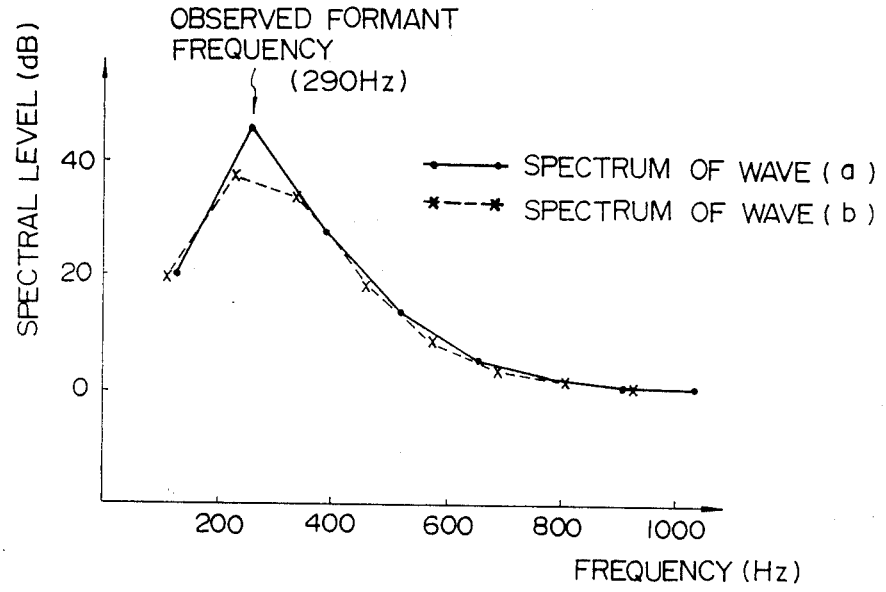
FIG. 3 is a graph which shows the analytical results of the waveforms (a) and (b) of FIG. 2 obtained by a conventional speech analysis method.
Figure 4:
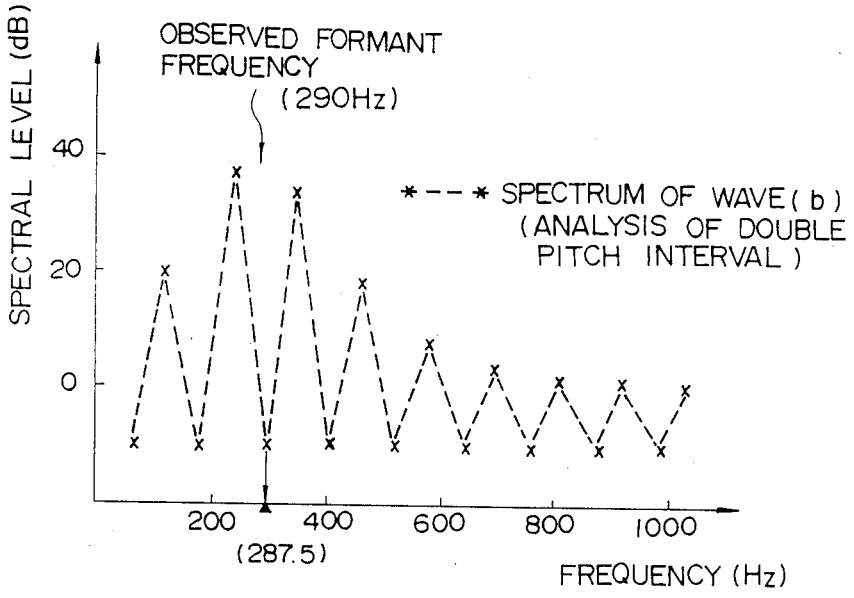
FIG. 4 is a graph showing the analytical result of that portion of the waveform (b) of FIG. 2 which has a duration twice longer than the pitch period.
Figure 13:
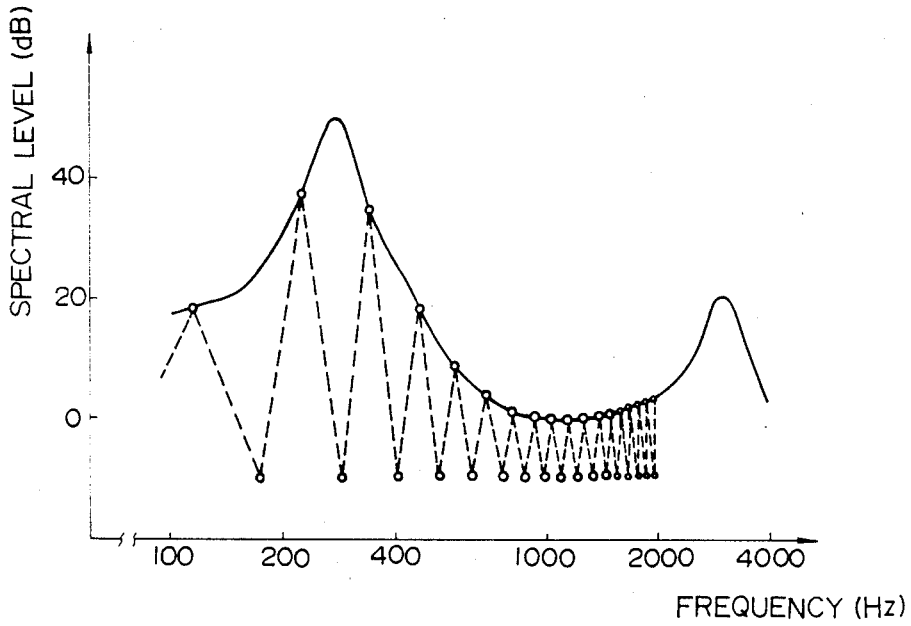
FIG. 13 is a graph showing an example of the spectrum obtained by the speech analysis method according to the present invention.

FIG. 13 shows spectra obtained by analyzing the speech waveform of FIG. 1. It is to be noted that, in order to clearly show formant components, numeral values on the abscissa of FIG. 13 are arranged on a logarithmic scale. In FIG. 13, a solid curve indicates a spectrum obtained by the speech analysis method according to the present invention, and dashed lines indicate a spectrum which corresponds to the spectrum of FIG. 4 and is obtained by the conventional speech analysis method using an analytical region equal in duration to a double-pitch waveform. In FIG. 13, that portion of the dashed-line spectrum which exceeds 2 KHz, is omitted, because the portion is difficult to illustrate.

As can be seen from FIG. 13, a speech analysis method according to the present invention can extract formant components accurately. Further, according to the present invention, even the spectrum of a speech waveform whose spectrum varies with time, such as a contracted sound can be accurately detected.

As has been explained in the above, according to the present invention, the spectrum of a speech signal whose spectrum varies with time, for example, the spectrum of a contracted sound can be accurately detected, and the accuracy of a detected spectrum is scarcely affected by variations in pitch period of input speech signal.

Further, according to the present invention, the tone quality of a synthetic speech and a speech recognition rate can be improved, because the spectrum of a speech signal is detected very accurately.

We claim:

1. A speech analysis method comprising:

a first step of sampling an input speech signal at a predetermined interval and converting the sampled signal into a digital signal by an A-D converter;

a second step of detecting the pitch period of that portion of the digital signal which exists between a predetermined one of periodically-generated timing pulses and a timing pulse adjacent to the predetermined timing pulse;

a third step of detecting a maximum-level position in that portion of the digital signal which exists in a period equal to the detected pitch period from the predetermined timing pulse;

a fourth step of tracing the digital signal from the maximum-level position in a time reversing direction to find a zero-crossing point where the level of the traced digital signal is first reduced to zero, and extracting a one-pitch signal which starts from the zero-crossing point and has a duration equal to the detected pitch period, from the digital signal;

a fifth step of adding a zero-level signal with a predetermined duration to the extracted one-pitch signal, to form a zero-inflated, one-pitch signal; and a sixth step of carrying out Fourier transform for the zero-inflated, one-pitch signal, to obtain a spectrum of the input speech signal.

2. A speech analysis method according to claim 1, wherein the predetermined duration of the zero-level signal added to the extracted on-pitch signal for forming the zero-inflated one-pitch signal in said fifth step is determined on the basis of the difference between the number of data points used in the Fourier transform and the number of data points included in the extracted one-pitch signal.

3. A speech analysis method according to claim 1, wherein the pitch period of the digital signal is detected by autocorrelation.

4. A speech analysis method according to claim 1, wherein said first step further includes a step of removing a predetermined high-frequency component from the digital signal by means of a low pass filter.

5. A speech analysis method according to claim 1 further comprising:

a seventh step of carrying out window multiplication for a predetermined portion of the digital signal having a duration equal to an integral multiple of the detected pitch period;

an eighth step of carrying out Fourier transform for the windowed digital signal to obtain a spectrum of the digital signal, the number of data points used in the Fourier transform of the eighth step being made equal to the number of data points used in the Fourier transform of the sixth step, the processing in the seventh and eighth steps being carried out in parallel with the processing in said third, fourth and fifth steps; and a ninth step of taking out the spectrum obtained in the sixth step for a low-frequency component lower than or equal to a predetermined boundary frequency and taking out the spectrum obtained in the eighth step for a high-frequency component higher than the boundary frequency, to combine two spectra, thereby obtaining an accurate spectrum of the input speech signal.

6. A speech analysis apparatus comprising:

means for sampling an input speech signal at a predetermined interval and for converting the sampled speech signal into a digital signal;

means for periodically generating timing pulses necessary for the analysis of the digital signal; and speech analysis means for analyzing the digital signal in response to a predetermined one of the timing pulses, the speech analysis means being made up of pitch detection means for detecting the pitch period of that portion of the digital signal which exists between the predetermined timing pulse and a timing pulse adjacent to the predetermined timing pulse, pitch waveform extraction means for extracting a one-pitch signal with a duration equal to the detected pitch period from the digital signal in such a manner that a maximum-level position in that portion of the digital signal which exists in a period equal to the detected pitch period from the predetermined timing pulse, is detected, the digital signal is traced from the maximum-level position in a time reversing direction to find a zero-crossing point where the level of the traced digital signal is first reduced to zero, and the zero-crossing point is used as the starting point of the one-pitch signal, zero inflating means for adding a zero-level signal with a predetermined duration to the extracted one-pitch signal, to form a zero-inflated, one-pitch signal, and spectrum analysis means for carrying out Fourier transform for the zero-inflated, one-pitch signal, to obtain a spectrum of the input speech signal.

7. A speech analyzing apparatus according to claim 6, wherein the predetermined duration of the zero-level signal added to the extracted one-pitch signal is determined on the basis of the difference between the number of data points used in the Fourier transform and the number of data points included in the extracted one-pitch signal.

8. A speech analysis apparatus comprising:

means for sampling an input speech signal at a predetermined interval and for converting the sampled speech signal into a digital signal;

means for periodically generating timing pulses necessary for the analysis of the digital signal;

first speech analysis means for analyzing the digital signal in response to a predetermined one of the timing pulses, the first speech analysis means being made up of pitch detection means for detecting the pitch period of that portion of the digital signal which exists between the predetermined timing pulse and a timing pulse adjacent to the predetermined timing pulse, pitch waveform extraction means for extracting a one-pitch signal with a duration equal to the detected pitch period from the digital signal in such a manner that a maximum-level position in that portion of the digital signal which exists in a period equal to the detected pitch period from the predetermined timing pulse, is detected, the digital signal is traced from the maximum-level position in a time reversing direction to find a zero-crossing point where the level of the traced digital signal is first reduced to zero, and the zero-crossing point is used as the starting point of the one-pitch signal, zero inflating means for adding a zero-level signal with a predetermined duration to the extracted one-pitch signal, to form a zero-inflated, one-pitch signal, and spectrum analysis means for carrying out Fourier transform for the zero-inflated, one-pitch signal to obtain a first spectrum of the input speech signal;

second speech analysis means for analyzing the digital signal in response to the predetermined timing pulse, the second speech analysis means being made up of means for carrying out window multiplication for a predetermined portion of the digital signal having a duration equal to an integral multiple of the detected pitch period, and means for carrying out Fourier transform for the windowed digital signal in such a manner that the number of data points used in the Fourier transform is made equal to the number of data points used in the Fourier transform of the first speech analysis means, to obtain a second spectrum of the input speech signal; and spectrum connection means for taking out the first and second spectra for a low-frequency component lower than or equal to a predetermined boundary frequency and a high-frequency component higher than the boundary frequency, respectively, to combine the first and second spectra, thereby forming a final spectrum.

9. A speech synthesis apparatus comprising a speech analysis apparatus according to claim 6.

10. A speech recognition apparatus comprising a speech analysis apparatus according to claim 6.

* * * * *